US008480428B1

(12) United States Patent
Sper et al.

(10) Patent No.: US 8,480,428 B1
(45) Date of Patent: Jul. 9, 2013

(54) WATERPROOF BNC CONNECTOR

(76) Inventors: Devin Sper, Scottsdale, AZ (US); Yufeng Ma, Beijing (CH)

( * ) Notice: Subject to any disclaimer, the term of this patent is extended or adjusted under 35 U.S.C. 154(b) by 6 days.

(21) Appl. No.: 13/346,190

(22) Filed: Jan. 9, 2012

(51) Int. Cl.
*H01R 13/52* (2006.01)

(52) U.S. Cl.
USPC ..... 439/521; 439/578

(58) Field of Classification Search
USPC ..... 439/521, 522, 578
See application file for complete search history.

(56) References Cited

U.S. PATENT DOCUMENTS 3,281,755 A * 10/1966 Trager ..... 439/320
3,449,706 A * 6/1969 Carissimi ..... 439/141
3,954,319 A * 5/1976 Haines ..... 439/294
4,691,974 A * 9/1987 Pinkerton et al. ..... 439/147
4,702,710 A * 10/1987 Dittman et al. ..... 439/271
4,703,989 A * 11/1987 Price et al. ..... 439/283
4,718,856 A * 1/1988 Pinkerton et al. ..... 439/147
4,806,116 A * 2/1989 Ackerman ..... 439/304
4,822,293 A * 4/1989 Robson ..... 439/271
4,917,617 A * 4/1990 Smith ..... 439/135
4,998,894 A * 3/1991 Gronvall ..... 439/521
5,041,000 A * 8/1991 Shotey ..... 439/147
5,090,917 A * 2/1992 Noorily et al. ..... 439/395
5,277,598 A * 1/1994 McMills et al. ..... 439/133
5,378,882 A * 1/1995 Gong et al. ..... 235/462.45
5,486,120 A * 1/1996 McMills et al. ..... 439/521
5,527,993 A * 6/1996 Shotey et al. ..... 174/67
5,564,938 A * 10/1996 Shenkal et al. ..... 439/301
5,589,665 A * 12/1996 Scamacca ..... 174/67
5,803,770 A * 9/1998 Swendson et al. ..... 439/676
5,816,835 A * 10/1998 Meszaros ..... 439/205
5,816,853 A * 10/1998 Buekers et al. ..... 439/521
5,857,865 A * 1/1999 Shimirak et al. ..... 439/277
5,989,052 A * 11/1999 Fields et al. ..... 439/373
6,409,532 B2 * 6/2002 Payson et al. ..... 439/320
6,435,911 B1 * 8/2002 Payson et al. ..... 439/606
6,475,009 B2 * 11/2002 Below et al. ..... 439/271
6,582,248 B2 * 6/2003 Bachman ..... 439/462
6,595,791 B2 * 7/2003 Below et al. ..... 439/271
6,817,902 B2 * 11/2004 Bernardi et al. ..... 439/676
6,918,787 B2 * 7/2005 Egan ..... 439/587
6,939,161 B1 * 9/2005 Yi et al. ..... 439/373
7,018,226 B2 * 3/2006 Milner et al. ..... 439/321
7,063,550 B1 * 6/2006 Chen et al. ..... 439/320
7,074,066 B2 * 7/2006 Pepe ..... 439/321
7,097,486 B2 * 8/2006 Parsons ..... 439/291
7,128,605 B2 * 10/2006 Montena ..... 439/578
7,175,459 B2 * 2/2007 Milner et al. ..... 439/271
7,179,100 B2 * 2/2007 Montena ..... 439/133
7,234,877 B2 * 6/2007 Sedor ..... 385/71
7,303,418 B2 * 12/2007 O'Connor ..... 439/277
7,311,555 B1 * 12/2007 Burris et al. ..... 439/594
7,316,583 B1 * 1/2008 Mistarz et al. ..... 439/589
7,367,848 B2 * 5/2008 John ..... 439/676
7,648,384 B2 * 1/2010 Desissard et al. ..... 439/367
7,686,930 B2 * 3/2010 Sydlowski et al. ..... 204/406
7,758,360 B2 * 7/2010 Lesage et al. ..... 439/147
7,824,108 B2 * 11/2010 Feldner ..... 385/56
7,838,775 B2 * 11/2010 Montena ..... 174/138 F
7,841,881 B2 * 11/2010 Hsu et al. ..... 439/277
7,857,647 B2 * 12/2010 Bracci et al. ..... 439/282

(Continued)

*Primary Examiner* — Ross Gushi
(74) *Attorney, Agent, or Firm* — Weiss & Moy, P.C.; Jeffrey D. Moy

(57) ABSTRACT

A pH meter and probe with a screw-down connector that converts a standard BNC pH probe connector into an IP67 waterproof connection.

7 Claims, 5 Drawing Sheets

U.S. PATENT DOCUMENTS

| | | | | |
|---|---|---|---|---|
| D631,848 | S * | 2/2011 | Montena et al. | D13/154 |
| 7,959,361 | B2 * | 6/2011 | Lu et al. | 385/53 |
| RE42,522 | E * | 7/2011 | Zimmel et al. | 385/55 |
| 7,988,476 | B2 * | 8/2011 | Billman et al. | 439/271 |
| 8,062,045 | B2 * | 11/2011 | Montena | 439/282 |
| 8,137,002 | B2 * | 3/2012 | Lu et al. | 385/78 |
| 8,202,008 | B2 * | 6/2012 | Lu et al. | 385/53 |
| 8,376,628 | B2 * | 2/2013 | Koreeda et al. | 385/75 |
| 2001/0036762 | A1 * | 11/2001 | Payson et al. | 439/320 |
| 2003/0148652 | A1 * | 8/2003 | Bernardi et al. | 439/462 |
| 2004/0038588 | A1 * | 2/2004 | Bernardi et al. | 439/587 |
| 2005/0064752 | A1 * | 3/2005 | Serino | 439/320 |
| 2006/0089049 | A1 * | 4/2006 | Sedor | 439/620 |
| 2006/0166554 | A1 * | 7/2006 | Hung | 439/589 |
| 2007/0025665 | A1 * | 2/2007 | Dean et al. | 385/78 |
| 2012/0286761 | A1 * | 11/2012 | Cheng | 324/71.1 |

* cited by examiner

WATERPROOF BNC CONNECTOR

TECHNICAL FIELD

A pH meter and probe with a screw-down connector that converts a standard BNC pH probe connector into an IP67 waterproof connection is disclosed.

BACKGROUND

Electrochemical pH meters are used to measure water quality and chemical solutions. Often, these meters make contact with the water or solution itself. Waterproof electrochemical meters have been available for some time. pH meters commonly use the pH industry standard BNC connector. The BNC connector is compatible with a wide selection of application specific pH probes, but is unfortunately not waterproof. When liquid is in contact with the connector, corrosion and other related problems can arise.

A number of solutions have been attempted to waterproof the probe connection none of them satisfactory. For example, BNC connectors on the meter are covered with a waterproof plug when not in use. When in use, however, the BNC connection is not waterproof. pH meters use non-standard, waterproof connectors specific to the manufacturer. These meters do not take advantage of the wide variety of pH probes compatible with industry standard BNC connectors. U.S. Pat. No. 4,702,710 purportedly discloses a BNC connector with a waterproof hood. However, movement in the probe cord, which happens when taking readings with the disclosed connector, opens a gap between the connector cover and the instrument allowing liquid to enter.

A need therefore exists for a waterproof BNC connector that overcomes those issues described above. These, as well as other related advantages, will be described in the present disclosure.

BRIEF DESCRIPTION OF DRAWINGS

DESCRIPTION OF THE DISCLOSURE pH meter 100 is shown in FIG. 1. pH probe 106 is attached to meter 100 through cable 108. Covering 410 surrounds a BNC connection with probe 106, which will be described in FIG. 4. Covering 510 for use with a temperature probe will be shown in FIG. 5. FIG. 2 is a view of pH probe 106 disconnected pH meter 100. Meter 100 has a standard BNC connector enabling it to connect with industry standard pH probes. Using pH probe 106 with screw down coverings 410 and 510, cord 108 can be pulled, yanked and manipulated without water or chemical solution entering BNC connector 404, temperature connector 504, or pH meter 100.

FIG. 3 is a top view of pH meter 100. Body 304 of meter 100 is surrounded by protective layer 302. O-rings 306 are placed between body 304 and protected layer 302. FIG. 4 shows a waterproof BNC connector for use with pH meter 100. BNC connector includes socket 402 and plug 404. Body 304 of meter 100 has external threading. Covering 410 surrounding BNC plug 404 has internal threading. The threaded section of covering 410 along with the threading of body 304 of meter 100 is used to tighten covering 410 to meter 100. O-ring 306 is placed between protective layer 302 and body 304 of meter 100. When covering 410 is tightened, a watertight seal is created over BNC socket 402 and plug 404. The BNC connector is enclosed through covering 410. When screwed down, covering 410 is also sealed at junction 414. Junction 414 is on cable 108 leading into BNC plug 404.

Figure 1:
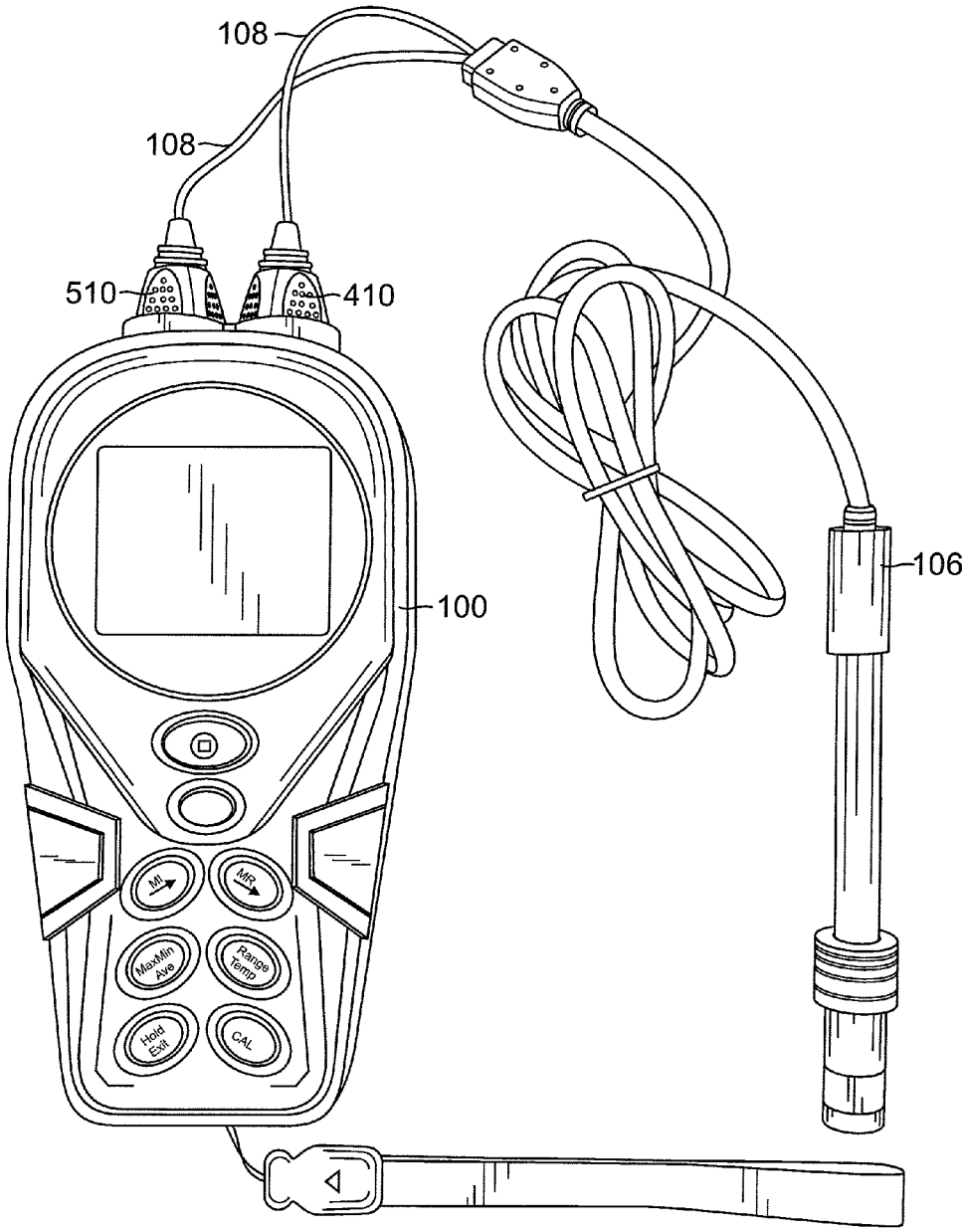
FIG. 1 is a pH meter for measuring water quality or chemical solution.
Figure 2:
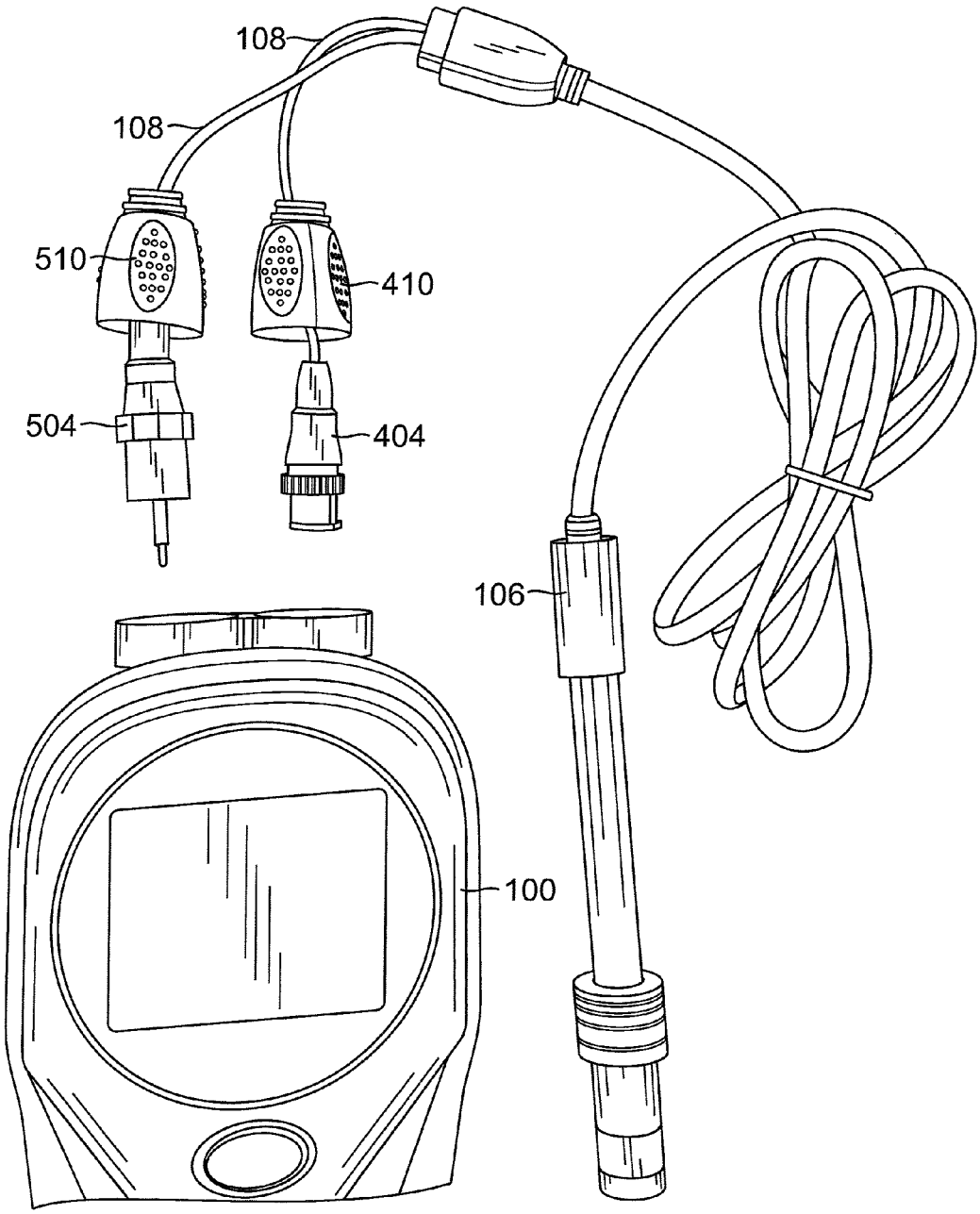
FIG. 2 is a view of a pH probe disconnected from the pH meter.
Figure 3:
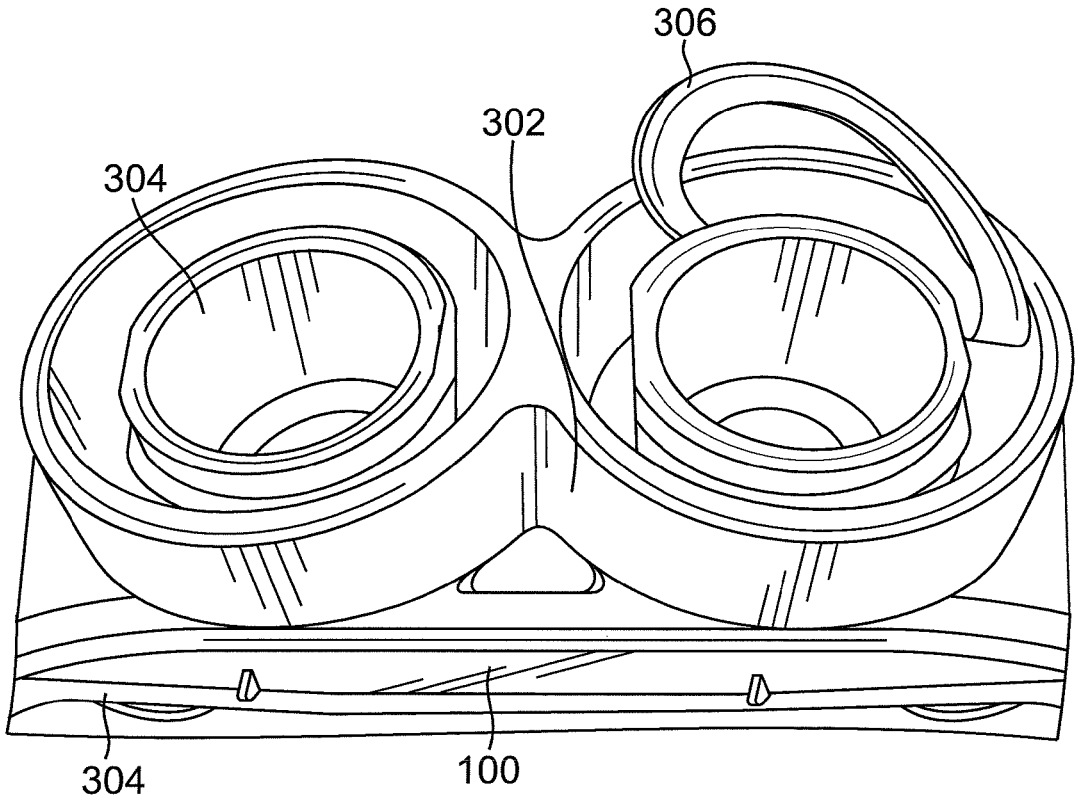
FIG. 3 is a top view of the pH meter.
Figure 4:
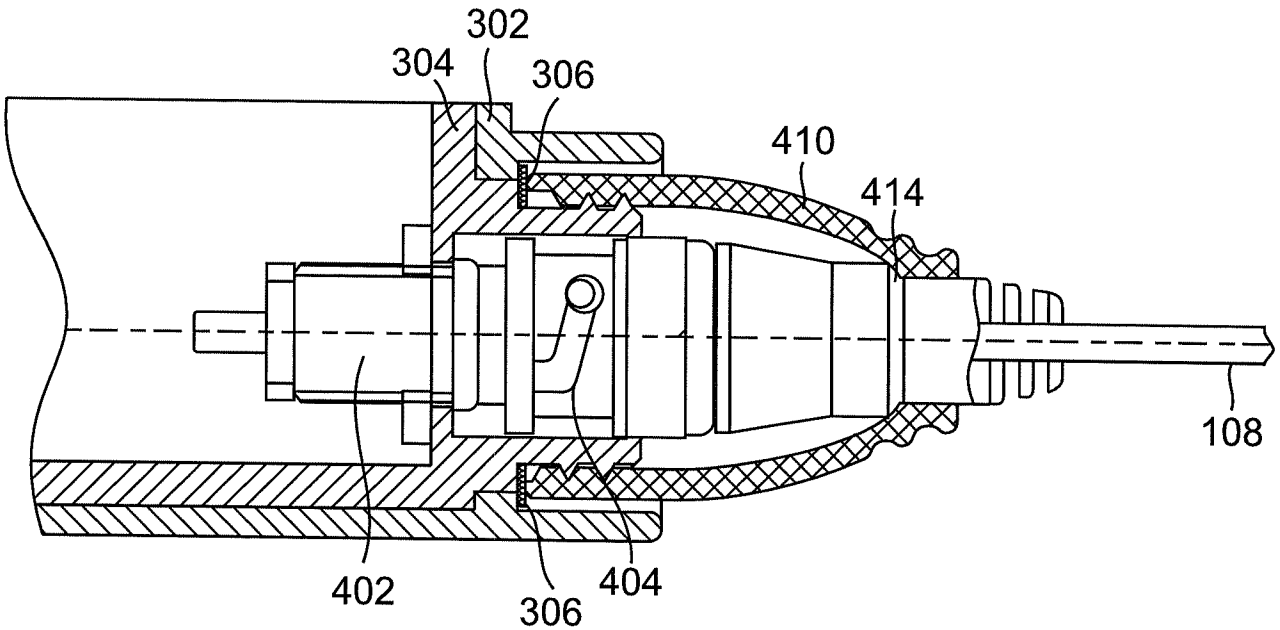
FIG. 4 is a waterproof BNC connector for use with the pH meter.

In operation, the user slides covering 410 down cable 108 to plug 404. When rotated, the internal threading of covering 410 locks into place with the external threading of body 304 of meter 100. O-ring 306 forms a watertight seal between body 304 and covering 410. As covering 410 is being rotated into the threading of body 304, another watertight seal is formed between covering 410 and probe cable 108 at junction 414.

Figure 5:
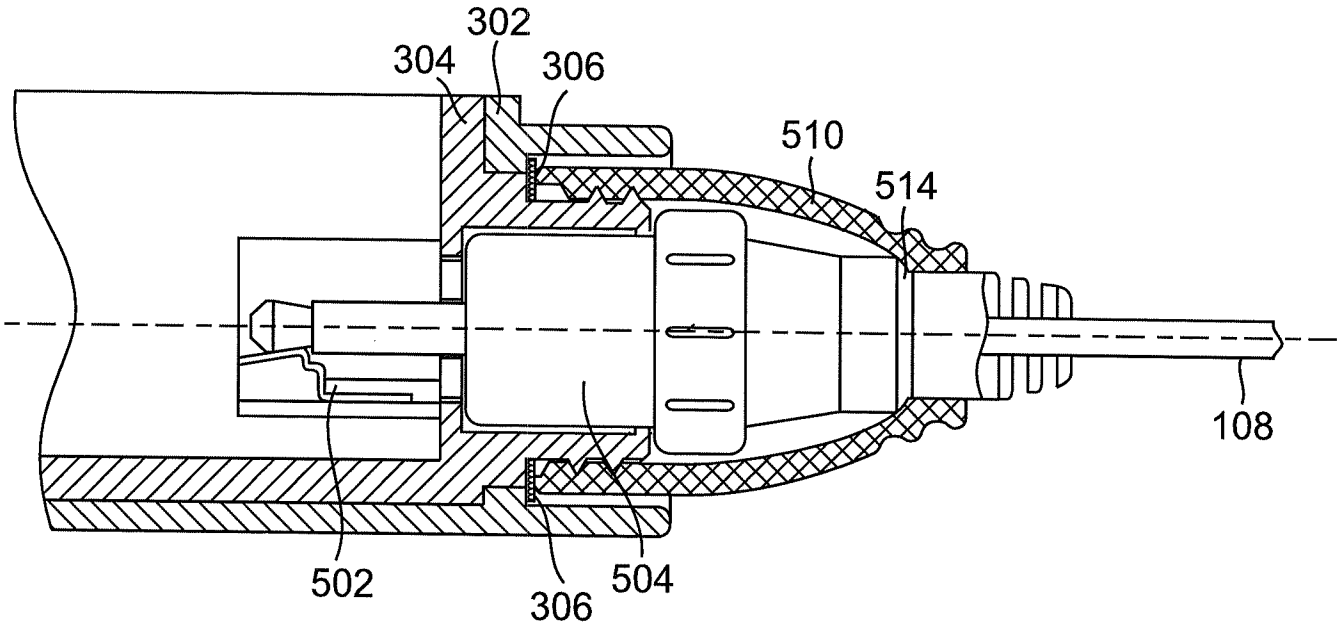
FIG. 5 is a waterproof temperature probe connector for use with the pH meter.

FIG. 5 shows a temperature probe connector for use with pH meter 100. The connector includes socket 502 and plug 504. Body 304 of meter 100 has external threading. Covering 510 surrounding plug 504 has internal threading. The threaded section of covering 510 along with the threading of body 304 of meter 100 is used to tighten the covering 510 to meter 100. O-ring 306 is placed between body 304 and protected layer 302 of meter 100. When covering 510 is tightened, socket 502 and plug 504 are sealed.

The temperature probe connector is enclosed through covering 510. When screwed down covering 510 is also sealed at junction 514. Junction 514 is on cable 108 leading into plug 504. In operation, the user slides covering 510 down cable 108 to plug 504. When rotated, the internal threading of covering 510 locks into place with the external threading of body 304 of meter 100. O-ring 306 forms a watertight seal between body 304 and covering 510. As covering 510 is being rotated into the threading of body 304, another watertight seal is formed between covering 510 and probe cable 108 at junction 514.

What is claimed is:

1. A BNC connection comprising:

a covering surrounding a BNC plug having a threaded section secured to threading on a meter around a socket and sealed at a junction on a cable leading to the plug, the socket and plug of the BNC connector joined with the covering forming a waterproof seal.

2. The BNC connection of claim 1, wherein the threaded section on the covering comprises internal threading.

3. The BNC connection of claim 2, wherein the threading formed on the meter comprises external threading fitted to the internal threading of the covering.

4. The BNC connection of claim 1, comprising an O-ring fitted below the threading.

5. A BNC connection comprising:

a BNC socket within a meter; and a waterproof covering surrounding the BNC connection and having a threaded portion secured to threading on the meter around the BNC plug and socket and secured to a cable leading to the plug.

6. The BNC connection of claim 5, comprising an O-ring fitted below the threading.

7. A meter comprising:

a probe connection having a BNC socket and plug coupled together covered by a waterproof connector having a threaded portion fitted to threading of the meter surrounding the BNC plug and socket and sealed to a cable leading into the plug; and a temperature probe having a socket and plug coupled together covered by a waterproof connector having a threaded portion fitted to threading of the meter surrounding the socket and plug and sealed to a cable leading into the plug.

* * * * *